US006095833A

United States Patent [19]

Osawa

[11] Patent Number: 6,095,833

[45] Date of Patent: Aug. 1, 2000

[54] LEVER-TYPE CONNECTOR

[75] Inventor: Hiroki Osawa, Yokkaichi, Japan

[73] Assignee: Sumitomo Wiring Systems, Ltd., Japan

[21] Appl. No.: 09/132,822

[22] Filed: Aug. 12, 1998

[30] Foreign Application Priority Data

Aug. 18, 1997 [JP] Japan ..... 9-221775

[51] Int. Cl.[7] ..... H01R 13/62

[52] U.S. Cl. ..... 439/157; 439/160

[58] Field of Search ..... 439/157, 159, 439/160

[56] References Cited

U.S. PATENT DOCUMENTS

| | | | |
|---|---|---|---|
| 5,104,330 | 4/1992 | Yagi et al. | 439/157 |
| 5,257,942 | 11/1993 | Taguchi | 439/157 |
| 5,269,696 | 12/1993 | Okada et al. | 439/157 |
| 5,320,544 | 6/1994 | Naoto et al. | 439/157 |
| 5,482,394 | 1/1996 | Shinchi et al. | 439/157 |
| 5,709,560 | 1/1998 | Hio | 439/157 |
| 5,888,080 | 3/1999 | Maejima | 439/157 |

FOREIGN PATENT DOCUMENTS 0 532 366 3/1993 European Pat. Off. .

*Primary Examiner*—Paula Bradley
*Assistant Examiner*—Briggitte Hammond
*Attorney, Agent, or Firm*—Banner & Witcoff, Ltd.

[57] ABSTRACT

A lever-type electrical connector has a moving support plate 15 to prevent bending of protruding male terminals of a male connector housing 11. The support plate 15 has external flanges 20,42 to prevent inward movement of cam pins 18,41 due to the application of external force to the base of the support plate 15.

The plate 15 may have a continuous upstanding wall 17 to further resist distortion due to external force.

7 Claims, 9 Drawing Sheets

LEVER-TYPE CONNECTOR

TECHNICAL FIELD

The present invention relates to a lever-type electrical connector.

BACKGROUND TO THE INVENTION

As shown in FIGS. 10 and 11 of this specification, a lever-type connector comprises a male connector housing 1 provided with a rotatable lever 2, and a moving plate 4 provided in such a manner that it can be moved within a hood member 3. This moving plate 4 is provided with positioning holes 4A which allow tabs (not shown) of male terminal fittings to be engaged therein. The moving plate 4 is provided with cam pins 5 which fit with cam grooves 2A of the lever 2, the operation of the lever 2 accordingly causing the plate 4 to move within the hood member 3. The cam pins 5 protrude outwards from the upper edges of upstanding members 6 of the moving plate 4, and pass through grooves 7 formed in the hood member 3 to the exterior.

The purpose of the moving plate is to resist bending of the exposed male terminals by an external object; as a female connector housing is attached, the plate is drawn inwardly to an inactive position.

In this kind of lever-type connector, if a force is exerted from above on the moving plate 4 in the direction shown by the arrow F in FIG. 11, the plate 4 bulges in a downwards direction, and consequently the protruding members 6 incline sharply inwards in the direction shown by the arrows R. As a result the cam pins 5 move inwardly and there is the danger that they might come out of the cam grooves 2A.

The present invention has been developed after taking the above problem into consideration and aims to present a lever-type connector in which the cam pins do not come out of the cam grooves if the moving plate bends.

SUMMARY OF THE INVENTION

According to the invention there is provided a lever-type electrical connector comprising a housing having a hood, a plurality of terminals protruding within the hood in a first direction, a support plate within said hood and having apertures through which individual terminals pass, and a lever pivotable on the housing, said hood having guide channels in opposite walls thereof and extending in said first direction, and said plate having opposite guide pins respectively extending through said channels to the exterior for engagement by said lever, such that pivoting of said lever moves said plate in said first direction in use characterized in that said guide pins have lateral protrusions at the respective outer ends thereof in order to prevent inward movement with respect to said hood.

Such a construction has the advantage that the support plate is restrained at the outside, and thus the cam pins are prevented from disengagement with the lever.

Preferably the cam pins are located on upstanding members of the support plate, most preferably a continuous peripheral wall. Such a construction gives improved support at the inside, and greater stiffness to the moving plate.

The protrusions are preferably located in a recessed channel so as to be flush with the exterior surface of the hood. In this way the overall size of the connector is not increased.

BRIEF DESCRIPTION OF DRAWINGS

Other features of the invention will be apparent from the following description of several preferred embodiments shown by way of example only in the accompanying drawings, in which.

DESCRIPTION OF PREFERRED EMBODIMENTS

Figure 1:
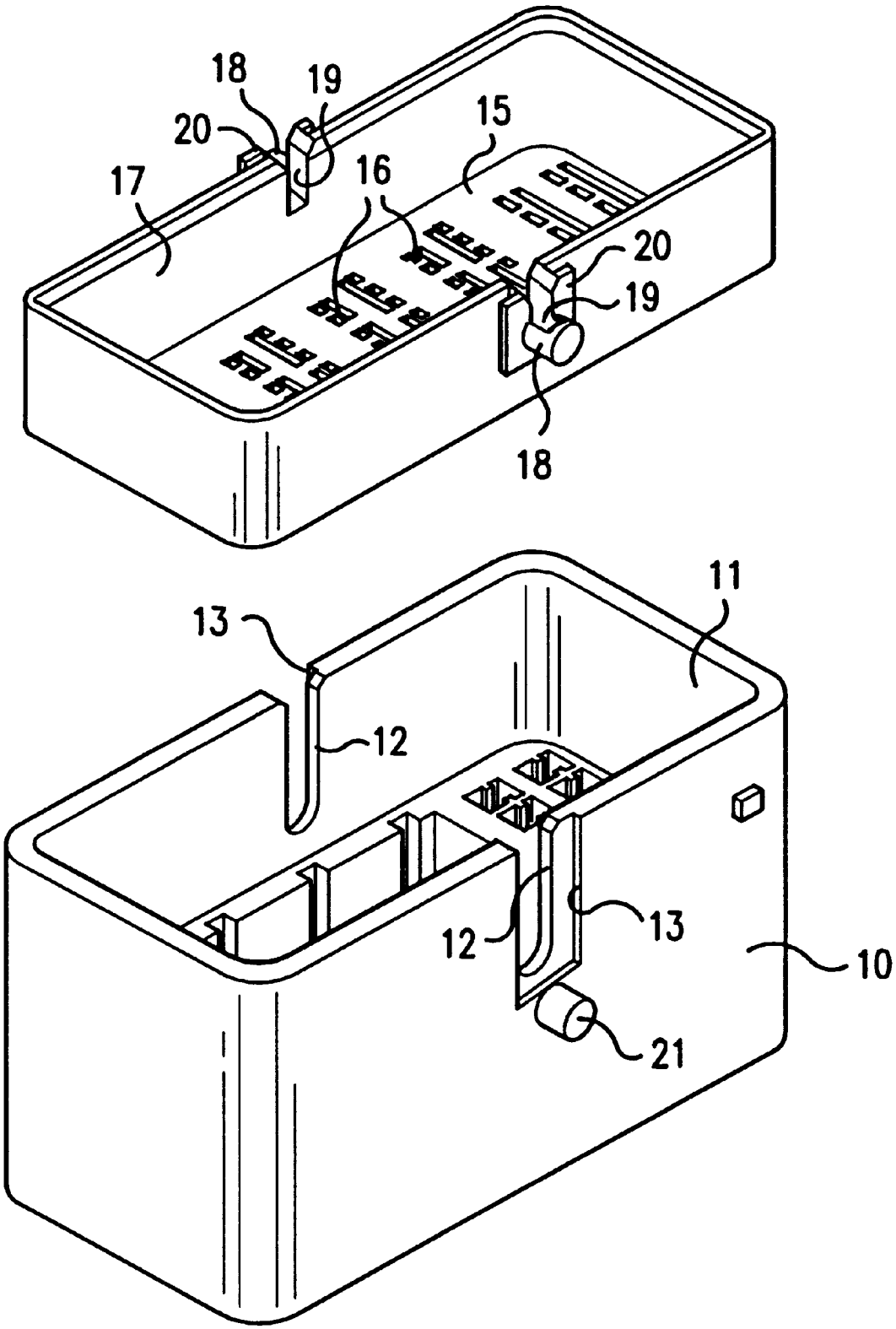
FIG. 1 is a diagonal view showing a male connector housing and a moving plate of a first embodiment in a disassembled state.
Figure 2:
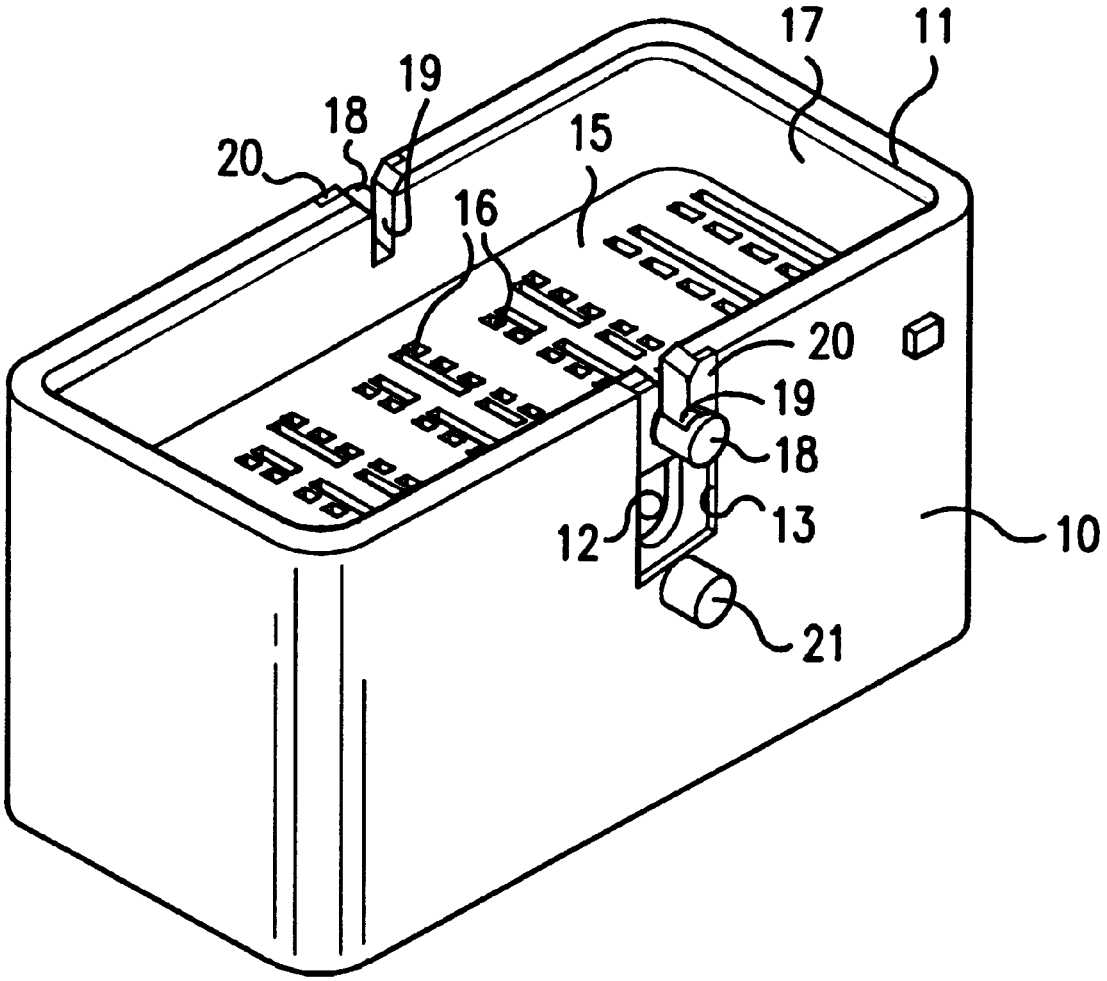
FIG. 2 is a diagonal view showing the male connector housing and the moving plate of the first embodiment in an attached state.

An embodiment one of the present invention is explained below with the aid of FIGS. 1 to 7.

A lever-type connector is provided with a male connector housing 10, a female connector housing 30, a lever 22 and a moving plate 15. The male connector housing 10 has a hood member 11 located on the face uppermost in the figures, a plurality of tabs of male terminal fittings (not shown) protruding upwards from the interior of the hood member 11. This hood member 11 fits with the female connector housing 30.

The hood member 11 has a plurality of positioning holes 16 and the moving plate 15 moves between an upper tab supporting position and a lower inactive position. When the male and female connector housings 10 and 30 are not in a fitted state the moving plate 15 is temporarily retained (see FIGS. 2 to 4) in the tab supporting position by a stopping means (not shown) such as a resilient detent, and the positioning holes 16 fit with the anterior ends of the tabs, thus preventing inclination or bending thereof. As the fitting operation of the connector housings 10 and 30 (to be described later) proceeds, the moving plate 15 moves downwards (towards the interior of the hood member 11) and, when the connector housings 10 and 30 are completely fitted, the moving plate 15 reaches the inactive position (shown in FIG. 5).

An upstanding wall 17 is formed around the entire circumference of the moving plate 15, cam pins 18 protruding from both side edges of the central portions of this wall 17. Wall 17 is preferably a substantially continuous peripheral wall. Channels 19 are formed in these cam pins 18 and on the upper edge of the wall 17, these channels 19 being open towards the upper end face and the inner face. The channels 19 fit with cam pins 31 of the female connector housing 30. The cam pins 18 of the moving plate 15 can move along recessed grooves or guide channels 12 formed in the hood member 11, the protruding edges (the end portions of the outer edges) of the cam pins 18 passing through the recessed grooves 12 and protruding towards the exterior. When the moving plate 15 is in the tab supporting position, the cam pins 18 are located in the upper ends of the recessed grooves 12 and when the moving plate 15 is in the inactive position, the cam pins 18 are located in the lower ends of the recessed grooves 12.

Flanges 20 are formed on the cam pins 18, and have an approximate U-shape which extends along the lower face and left and right side faces of the cam pins 18. That is, they follow along the area outside the openings of the channels 19 of the cam pins 18.

Recesses 13 close to the recessed grooves 12 are formed by cutting away the external face along the U-shaped part of the opening edges of the recessed grooves 12. The flanges 20 make contact with the external face of these recesses 13. Flanges 20 locate without substantial play in recesses 13, that is, flanges 20 are movable along recesses 13 without substantial play in any direction other than along the recesses.

Supporting axles 21, which support a lever 22, are formed on the external side face of the hood member 11 at a location slightly lower than the lower edge of the recessed grooves 12. A pair of arms 24 protrude from both ends of an operating member 23 of this lever 22, the wider portion of the anterior ends of these arms 24 having axle receiving holes 25 into which the supporting axles 21 fit. These receiving holes 25 form the centre of spiral-shaped cam grooves 26, and both the receiving holes 25 and the cam grooves 26 pass through the arms 24 from the inside to the outside.

Figure 4:
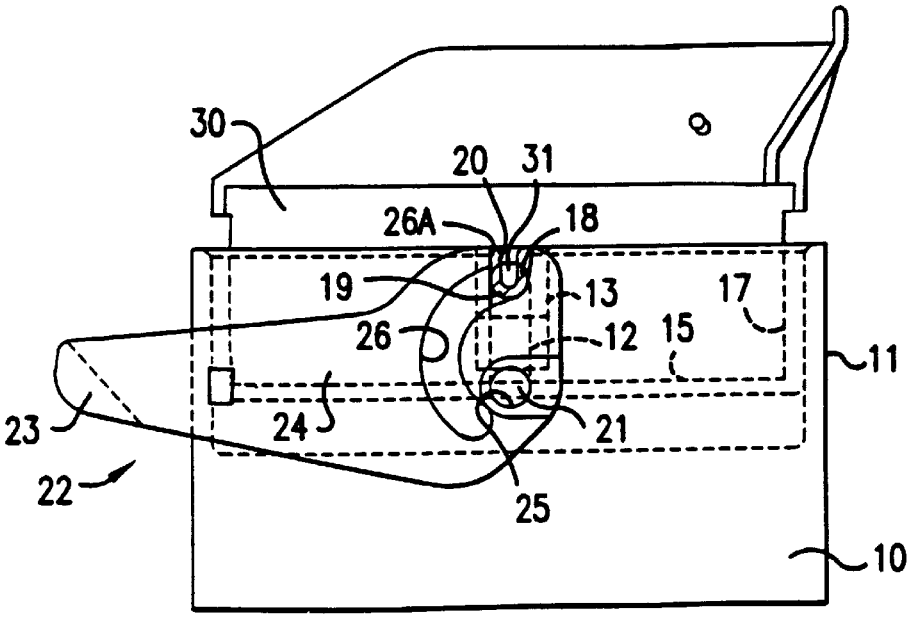
FIG. 4 is a side view showing the male connector housing and the female connector housing of the first embodiment while the two are being fitted together.
Figure 5:
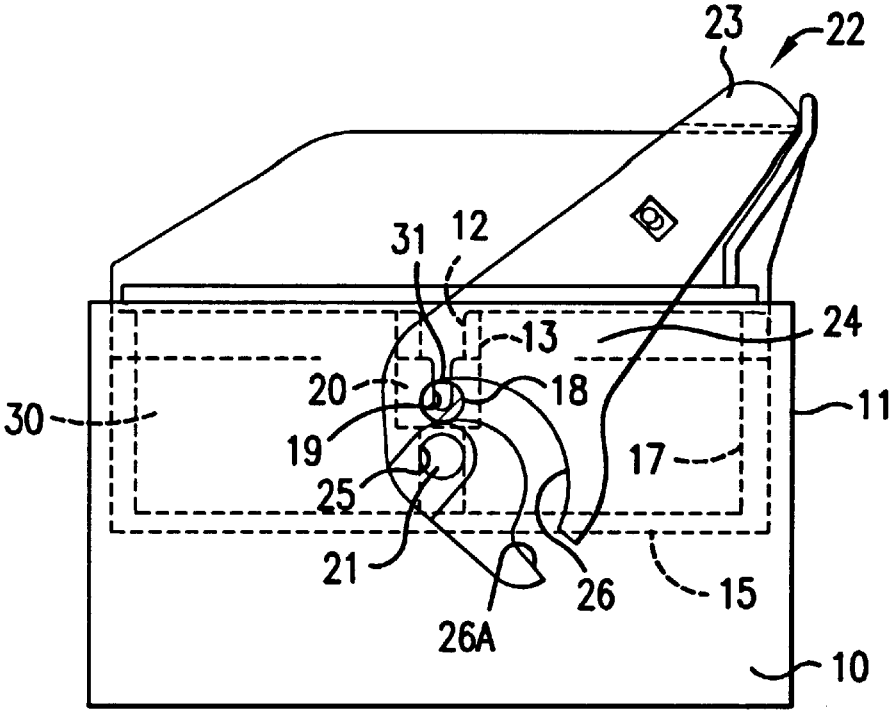
FIG. 5 is a side view showing the male connector housing and the female connector housing of the first embodiment in a fitted state.
Figure 6:
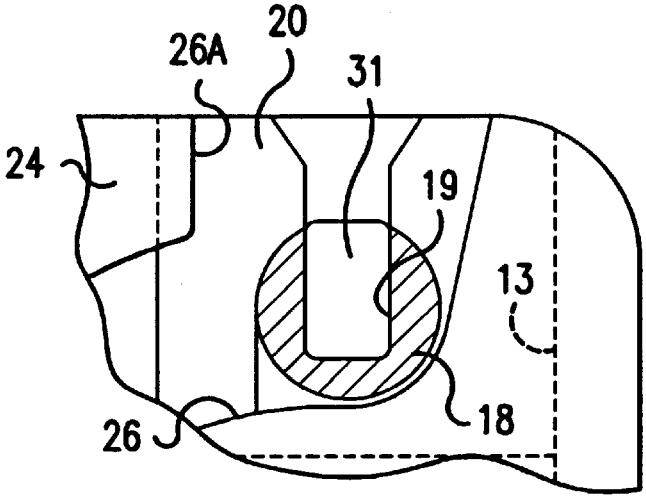
FIG. 6 is a partially expanded side view of a change of position regulating means of the first embodiment.
Figure 7:
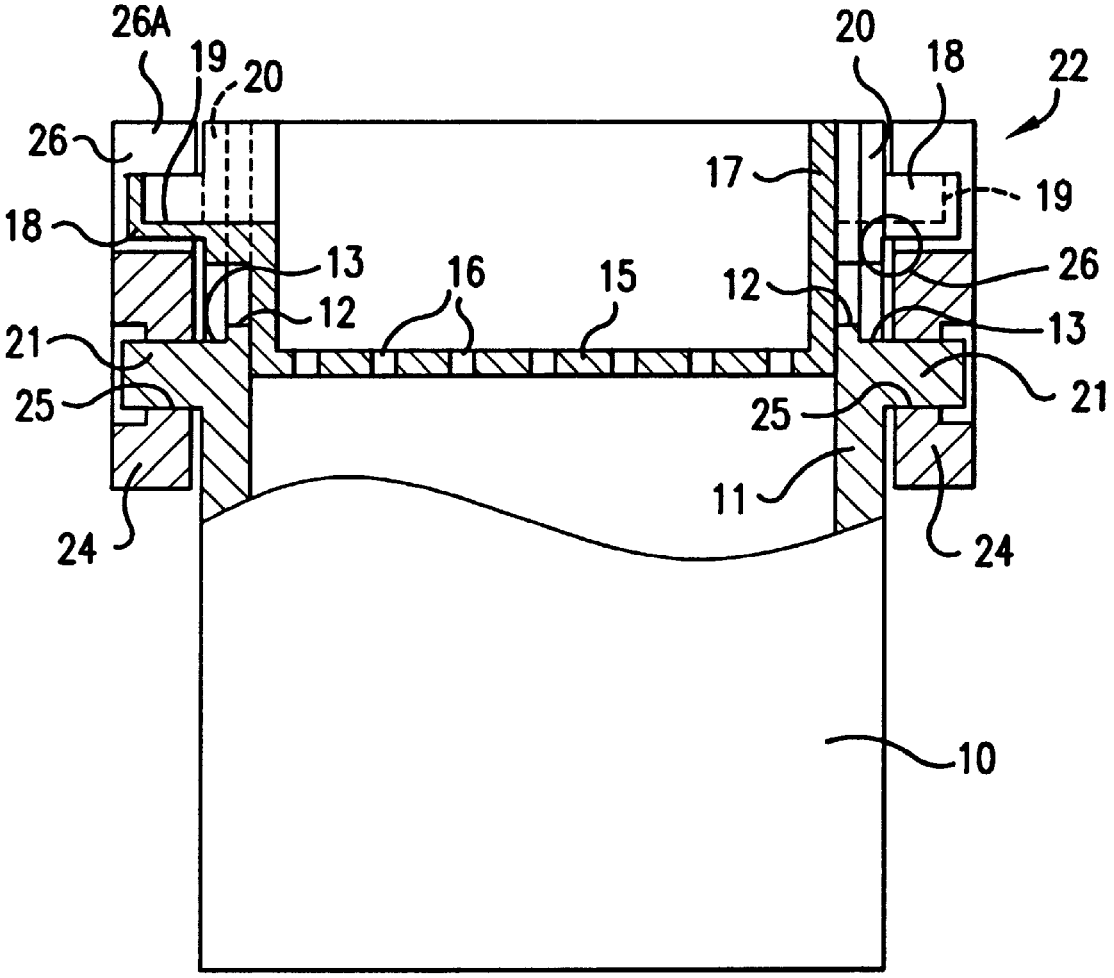
FIG. 7 is a cross-sectional view showing the male connector housing and the moving plate of the first embodiment in an attached state.

When the supporting axles 21 are fitted with the supporting holes 25 of the lever 22, a rotative operation can be performed between a fitting starting position (see FIGS. 3 and 4) and a fitting completion position (see FIG. 5). In the fitting starting position, entering holes 26A of the cam grooves 26 fit with the upper end portion of the recessed grooves 12. The female connector housing 30 has a plurality of female terminal fittings (not shown) which fit with the tabs of the male terminal fittings, the lower end of the female connector housing 30 fitting with the hood member 11 of the male connector housing 10. Cam pins 31 are formed on both side faces of the female connector housing 30, these cam pins 31 fitting tightly with the channels 19. Whereas the cam pins 18 of the moving plate 15 are approximately cylindrical in shape, the cam pins 31 of the female connector housing 30 are approximately square.

Next the operation of the present embodiment is explained.

When the moving plate 15 and the lever 22 are to be attached to the male connector housing 10, the lever 22 is attached first and then brought down to the fitting starting position. In this state, the moving plate 15 is fitted into the hood member 11. At this juncture, the cam pins 18 fit with the upper end portions of the recessed grooves 12, the flanges 20 come into contact with the external faces of the recesses 13 and the tabs fit with the positioning holes 16, thus temporarily retaining the moving plate 15 in the tab supporting position (see FIG. 3). In this state the cam pins 18 fit with the entering holes 26A of the cam grooves 26.

The female connector housing 30 is fitted from this state. The lower end of the female connector housing 30 is temporarily fitted into the hood member 11, and the cam pins 31 of the female connector housing 30 fit with the channels 19 of the cam pins 18 of the moving plate 15, the cam pins 18 and 31 forming a unified body.

Figure 3:
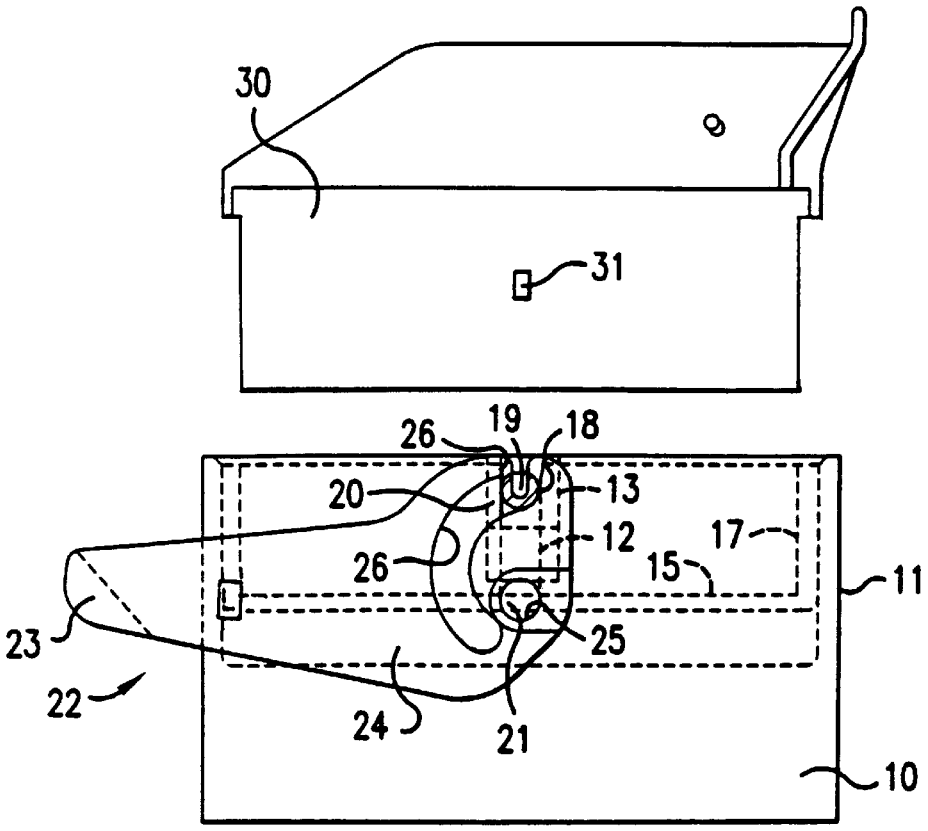
FIG. 3 is a side view showing the male connector housing and a female connector housing of the first embodiment in a state prior to being fitted together.

After the cam pins 18 and 31 form a unified body, the lever 22 is rotated in a clock-wise direction, as shown in FIGS. 3 to 5. The cam pins 18 and 31, are engaged by the cam grooves 26 and are drawn in a unified manner into the hood member 11. The lever 22 reaches the fitting completion position, placing the connector housings 10 and 30 in a completely fitted state; the moving plate 15 reaches the inactive position.

When the female connector housing 30 has not yet been fitted, the moving plate 15 remains in an exposed state within the hood member 11 and, as a result, an external force can be exerted on the moving plate 15 from above. If the moving plate 15 bulges and bends in a downwards direction due to this external force, a force is exerted on the wall 17 that makes it bend in an inward direction. However, the present embodiment is provided with flanges 20 on the cam pins 18 of the moving plate 15, these flanges 20 fitting with the recessed grooves 12 of the hood member 11 from their outer sides. This engagement regulates the change of position in the interior direction of the wall 17 and therefore also prevents the change of position in the interior direction of the cam pins 18. Consequently, there is no danger that the cam pins 18 will come out of the cam grooves 26. Further, in the present embodiment the wall 17 is formed as a frame around the entire periphery of the moving plate 15 and therefore the wall 17 itself regulates its change of position in the interior direction. As a result, the change of position of the cam pins 18 is regulated in an even more reliable manner.

Figure 8:
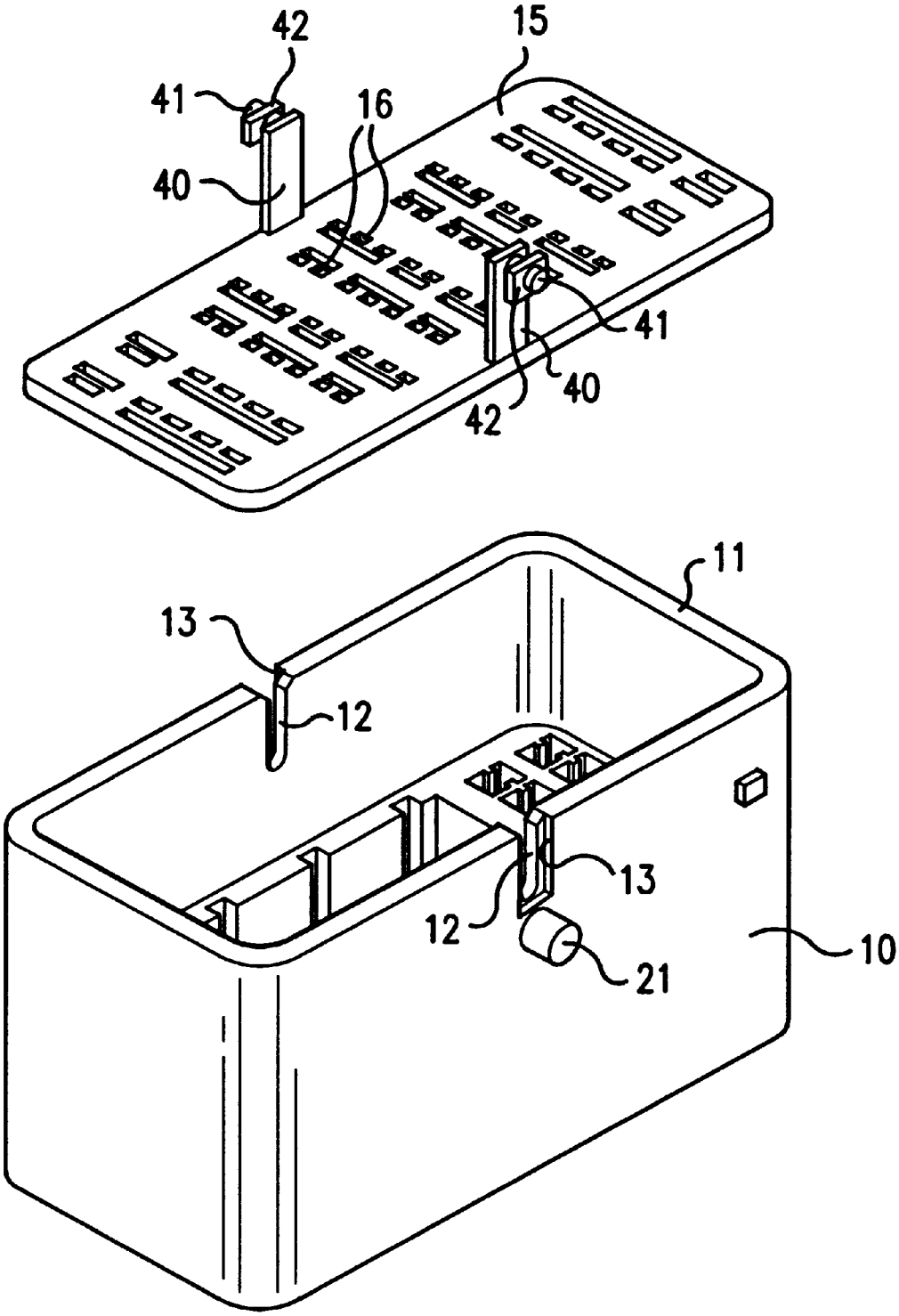
FIG. 8 is a diagonal view showing a male connector housing and a moving plate of a second embodiment in a disassembled state.
Figure 9:
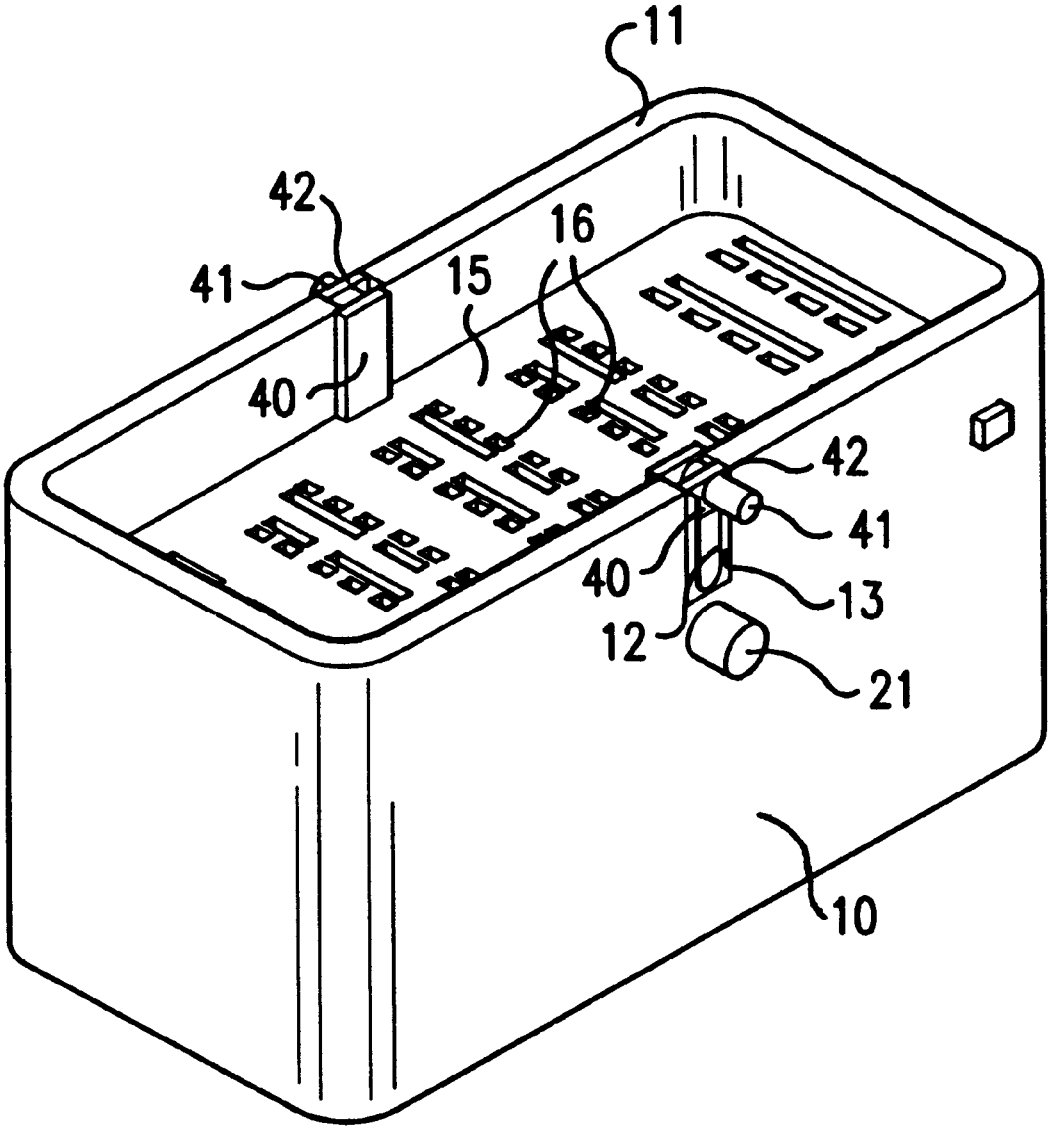
FIG. 9 is a diagonal view showing the male connector housing and the moving plate of the second embodiment in an attached state.
Figure 10:
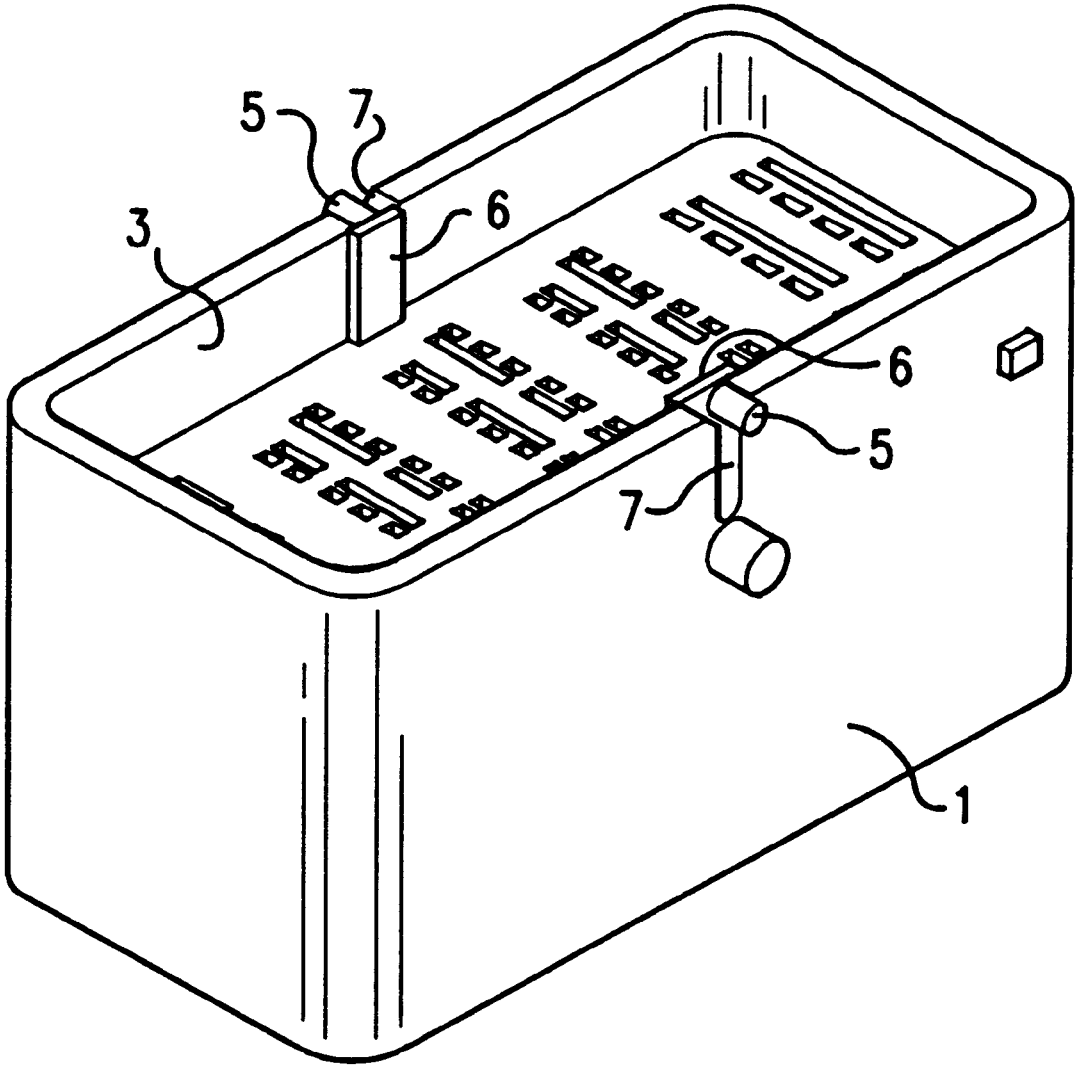
FIG. 10 PRIOR ART
FIG. 10 is a diagonal view of a prior art example.
Figure 11:
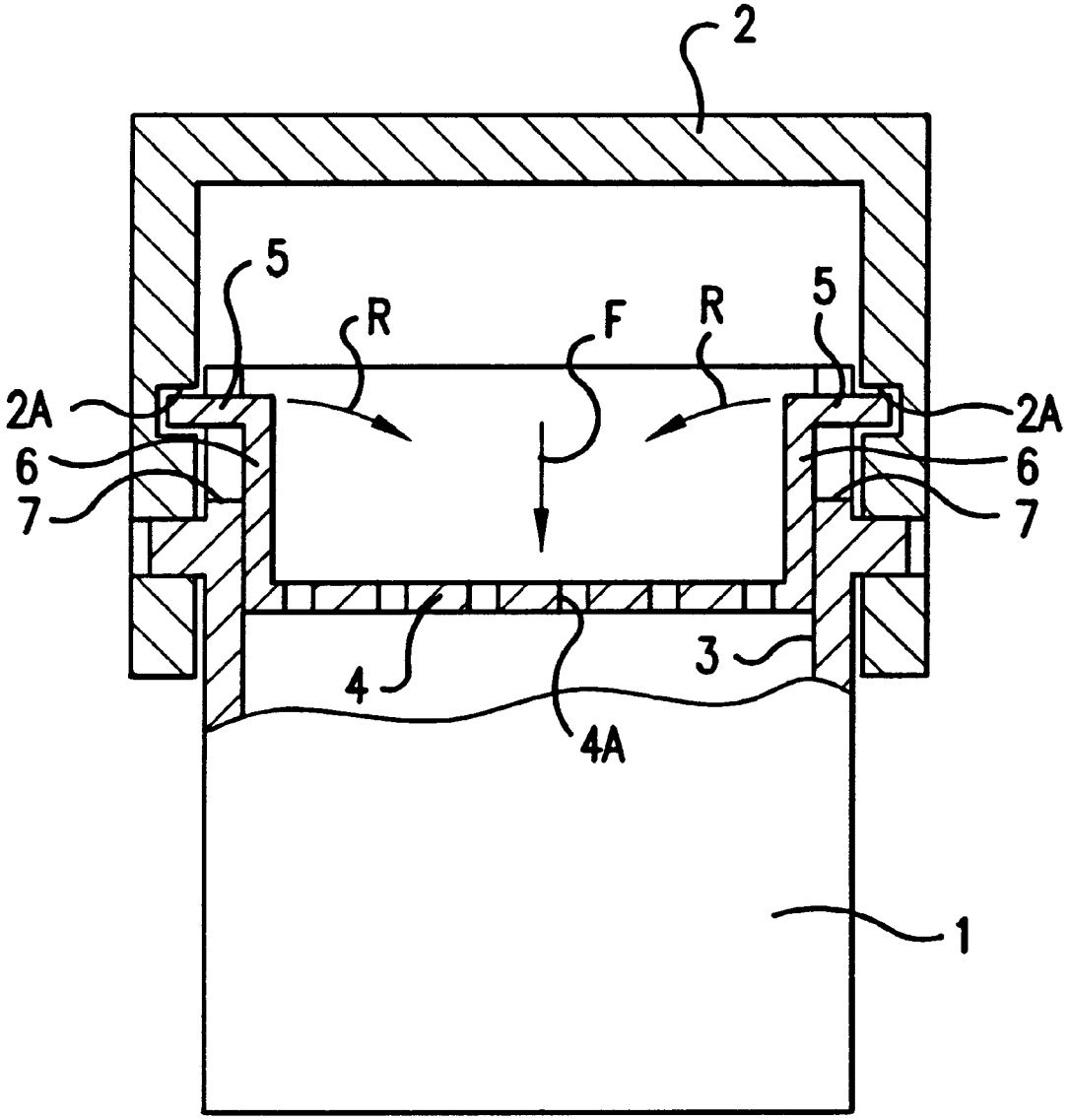
FIG. 11 PRIOR ART
FIG. 11 is a cross-sectional view of the prior art example.

Next, a second embodiment of the present invention is explained with the aid of FIGS. 8 and 9.

In this embodiment the configuration of the upstanding wall and the cam pins differs from that of embodiment one. Since the configuration of the other parts is the same as in the first embodiment, the same numbers as in embodiment one are accorded to parts having the same configuration, and an explanation of the configuration, operation and effects of these is omitted.

In embodiment one the wall 17 is formed as a frame around the entire periphery of the moving plate 15. In embodiment two, long and narrow plate-shaped rising members 40 protrude from a central location on both side edges of the moving plate 15. Cam pins 41 protrude from the upper edges of the rising members 40.

Further, embodiment one is provided with channels 19 which allow the cam pins 18 to fit with the cam pins 31 of the female connector housing 30, but embodiment two is not so provided. Consequently the cam pins 31 of the female connector housing 30 (not shown in FIGS. 8 or 9) and the cam pins 41 of the moving plate 15 fit separately with two cam grooves (not shown) provided on the lever. These two cam grooves on the lever have the usual configuration and therefore a detailed explanation thereof is omitted.

In embodiment two, flanges 42 are formed on the external periphery of the cam pins 41, these flanges 42 fitting with the receiving members 13 of the recessed grooves 12 in such a way that they can slide along the external faces thereof. Consequently, even if a position-changing force is exerted to cause the moving plate 15 to bend in a downwards direction and the rising members 40 to move in an inwards direction, the flanges 42 fit with the recesses 13 from their outer sides and the change of position in the interior direction of the rising member 40 and the cam pins 41 is reliably prevented.

Furthermore, the present invention is not limited to the embodiments described above with the aid of figures. For example, the possibilities described below also lie within the technical range of the present invention. In addition, the present invention may be embodiment in various other ways without deviating from the scope thereof.

In embodiment one, the wall 17 forms a surrounding frame and performs the function of regulating the inward movement of the cam pins 18. However, according to the present invention, the wall need not be continuous, but may equally well be configured to have a long and narrow plate shape on the upper ends of which cam pins are formed (similar to embodiment 2).

In embodiment two, the rising members 40 of the moving plate 15 have a long and narrow plate shape. However, according to the present invention a continuous wall as in embodiment one, the rising member may also perform the function of regulating the inward movement of the rising member and the cam pins.

What is claimed is:

1. A lever-type electrical connector comprising a housing having a hood, a plurality of terminals protruding within the hood in a first direction, a support plate movable in said first direction within said hood and having apertures through which individual terminals pass, and a lever pivotable on the housing, said hood having guide channels in opposite walls thereof and extending in said first direction, and said plate having opposite guide pins respectively extending through said channels to the exterior for engagement by said lever, such that pivoting of said lever moves said guide pins along said channels and moves said plate in said first direction in use, wherein said guide pins have lateral protrusions which engage said hood and move along said channels in order to prevent inward movement of said guide pins with respect to said hood.

2. The connector according to claim 1 wherein said plate includes opposite upstanding members from which said guide pins project.

3. The connector according to claim 2 wherein said upstanding members comprise a substantially continuous peripheral wall.

4. The connector according to claim 1 wherein said hood has an exterior surface, and said surface is provided with a recess on opposite sides of said guide channels, said lateral protrusions being located within said recesses flush with said exterior surface.

5. A connector according to claim 4 wherein said lateral protrusions move along said recesses without substantial play in any direction other than along said recesses.

6. The connector according to claim 4 wherein said lateral protrusions comprises planar flanges.

7. A connector according to claim 6 wherein said flanges move along said recesses without substantial play in any direction other than along said recesses.

* * * * *